US010294558B2

(12) United States Patent
Machado Amorim et al.

(10) Patent No.: US 10,294,558 B2
(45) Date of Patent: May 21, 2019

(54) METHOD FOR PRODUCING A METAL SHEET HAVING OILED ZN—AL—MG COATINGS, AND CORRESPONDING METAL SHEET

(71) Applicant: ARCELORMITTAL INVESTIGACIÓN Y DESARROLLO, S.L., Sestao, Bizkaia (ES)

(72) Inventors: Tiago Machado Amorim, Metz (FR); Joëlle Richard, Chantilly (FR); Eric Jacqueson, Longeville les Metz (FR); Audrey Lhermeroult, Metz (FR); Pascale Feltin, Saint Privat la Montagne (FR); Jean-Michel Lemaire, Villers Saint Paul (FR); Luc Diez, Metz (FR); Jean-Michel Mataigne, Senlis (FR)

(73) Assignee: ARCELORMITTAL INVESTIGACION Y DESARROLLO, S.L., Sestao Bizkaia (ES)

( * ) Notice: Subject to any disclaimer, the term of this patent is extended or adjusted under 35 U.S.C. 154(b) by 0 days.

(21) Appl. No.: 14/397,108

(22) PCT Filed: Apr. 25, 2013

(86) PCT No.: PCT/IB2013/053286

§ 371 (c)(1),
(2) Date: Oct. 24, 2014

(87) PCT Pub. No.: WO2013/160871

PCT Pub. Date: Oct. 31, 2013

(65) Prior Publication Data

US 2015/0125714 A1 May 7, 2015

(30) Foreign Application Priority Data

Apr. 25, 2012 (WO) ..... PCTFR2012/050906

(51) Int. Cl.
*C23C 2/26* (2006.01)
*C23C 28/00* (2006.01)
(Continued)

(52) U.S. Cl.
CPC ..... *C23C 2/26* (2013.01); *C23C 2/06* (2013.01); *C23C 22/06* (2013.01); *C23C 28/321* (2013.01); *Y10T 428/12549* (2015.01)

(58) Field of Classification Search
CPC ..... C23C 2/06; C23C 28/321
See application file for complete search history.

(56) References Cited

U.S. PATENT DOCUMENTS 5,397,652 A 3/1995 Carey, II et al.
2003/0175547 A1* 9/2003 Carey, II et al. ..... C23C 2/06 428/648

(Continued)

FOREIGN PATENT DOCUMENTS

CN 101466254 A * 6/2009
CN 101466254 A 6/2009
CN 101707942 A 5/2010
EP 1199376 A1 4/2002

(Continued)

*Primary Examiner* — Dah-Wei D. Yuan
*Assistant Examiner* — Kristen A Dagenais-Englehart
(74) *Attorney, Agent, or Firm* — Davidson, Davidson & Kappel, LLC

(57) ABSTRACT

A method for producing a metal sheet is provided. The method includes providing a steel substrate having two faces, depositing a metal coating on each face by dipping the substrate in a bath, cooling the metal coatings, altering layers of magnesium oxide or magnesium hydroxide formed on the outer surfaces of the metal coatings, and depositing a layer of oil on the outer surfaces of the metal coatings.

22 Claims, 3 Drawing Sheets

(51) Int. Cl.
*C23C 2/06* (2006.01)
*C23C 22/06* (2006.01)

(56) References Cited

U.S. PATENT DOCUMENTS

| | | | | |
|---|---|---|---|---|
| 2008/0308192 | A1 | 12/2008 | Bello et al. | |
| 2010/0055344 | A1* | 3/2010 | Ostwald | C23C 2/02 427/558 |
| 2011/0139308 | A1 | 6/2011 | Peruzzi et al. | |

FOREIGN PATENT DOCUMENTS

| | | | | |
|---|---|---|---|---|
| EP | 1466994 | A1 | | 10/2004 |
| JP | 07197228 | A | * | 8/1995 |
| JP | H07197228 | A | | 8/1995 |
| JP | 2000328221 | A | | 11/2000 |
| JP | 2000328221 | A | * | 11/2000 |
| JP | 2002302776 | A | | 10/2002 |
| JP | 2003013192 | A | | 1/2003 |
| JP | 2003055776 | A | | 2/2003 |
| JP | 2003138385 | A | | 5/2003 |
| JP | 2003/277904 | A | | 10/2003 |
| JP | 2005290551 | A | | 10/2005 |
| JP | 2006124824 | A | | 5/2006 |
| JP | 2006124824 | A | * | 5/2006 |
| JP | 2007002288 | A | | 1/2007 |
| JP | 2007131906 | A | | 5/2007 |
| JP | 2007517135 | A | | 6/2007 |
| JP | 2009537698 | A | | 10/2009 |
| JP | 2010070851 | A | | 4/2010 |
| JP | 2010070851 | A | * | 4/2010 |
| RU | 2417273 | C2 | * | 4/2011 |
| RU | 2417273 | C2 | | 4/2011 |

* cited by examiner

METHOD FOR PRODUCING A METAL SHEET HAVING OILED ZN—AL—MG COATINGS, AND CORRESPONDING METAL SHEET

The present invention relates to a metal sheet comprising a steel substrate having two faces each coated with a metal coating comprising zinc, magnesium and aluminum.

BACKGROUND

Such metal sheets are more particularly intended to manufacture parts for the automobile industry, but are not limited thereto.

The metal coatings, essentially comprising zinc and aluminum in small proportions (typically approximately 0.1 wt %), are traditionally used for good corrosion protection. These metal coatings are currently subject to competition in particular from coatings comprising zinc, magnesium and aluminum.

Such metal coatings will be globally referred to hereinafter as zinc-aluminum-magnesium or ZnAlMg coatings.

Adding magnesium significantly increases the resistance of these coatings to corrosion, which may make it possible to reduce their thickness or increase the corrosion protection guarantee over time.

The coils of metal sheets with such surface coatings may reside in storage hangars for several months, and that surface must not be altered by the appearance of surface corrosion, before being shaped by the end user. In particular, no beginning of corrosion must appear, regardless of the storage environment, even in case of exposure to the sun and/or a wet or even salty environment.

Standard galvanized products, i.e., the coatings of which essentially comprise small proportions of zinc and aluminum, are also subjected to these stresses and are coated with a protective oil that is generally sufficient to provide protection against corrosion during storage.

SUMMARY OF THE INVENTION

However, the present inventors have noted, with the metal sheets with Zn—Al—Mg coatings, dewetting phenomena of the protective oil and dulling, in particular of the entire surface not covered with oil anymore.

An object of the invention is to improve the temporary protection of metal sheets with Zn—Al—Mg coatings.

The present invention provides a method for producing a metal sheet having two faces each coated with a metal coating comprising zinc, between 0.1 and 20 wt % of aluminum, and between 0.1 and 10 wt % of magnesium. The method comprising at least the following steps: providing a steel substrate having two faces, depositing a metal coating on each face by dipping the substrate in a bath, cooling the metal coatings, altering layers of magnesium oxide or magnesium hydroxide formed on the outer surfaces of the metal coatings by applying an acid solution on the outer surfaces of the metal coatings and/or by applying mechanical forces using a roller leveler, a brushing device, or a shot-blasting device on the outer surfaces of the metal coatings and depositing a layer of oil on the outer surfaces of the metal coatings.

The invention also provides a metal sheet having two faces each coated with a metal coating comprising zinc, aluminum and magnesium and with a layer of oil, the metal coatings comprising between 0.1 and 20 wt % of aluminum and 0.1 and 10 wt % of magnesium. The metal sheet may be obtained by the method above according to the present invention.

BRIEF DESCRIPTION OF THE DRAWINGS

The invention will now be illustrated through examples provided for information, and non-limitingly, in reference to the appended figures, in which.

DETAILED DESCRIPTION

Figure 1:
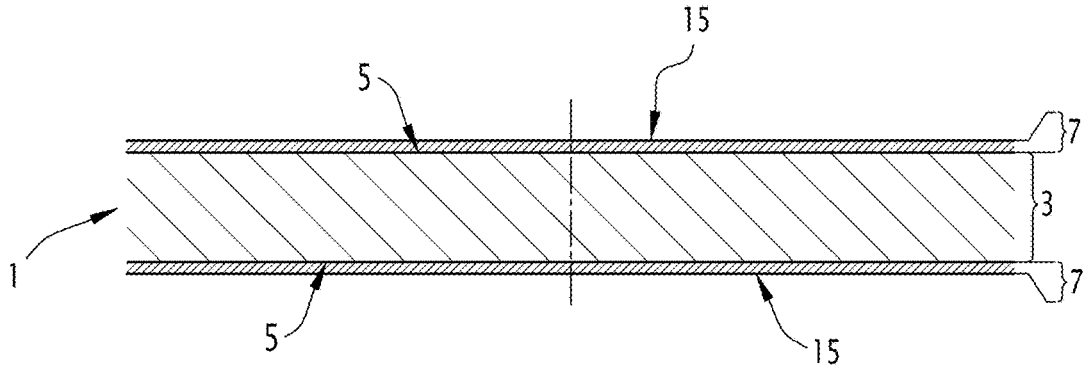
FIG. 1 is a diagrammatic cross-sectional view illustrating the structure of a metal sheet obtained using a method according to the present invention.

The metal sheet 1 of FIG. 1 comprises a steel substrate 3 covered on each of its two faces 5 by a metal coating 7.

It will be noted that the relative thicknesses of the substrate 3 and of the coatings 7 covering are not shown to scale in FIG. 1 in order to facilitate the illustration.

The coatings 7 present on the two faces 5 are similar, and only one will be described in detail below.

The coating 7 generally has a thickness smaller than or equal to 25 μm, for example, and traditionally aims to protect the substrate 3 from corrosion.

The coating 7 comprises zinc, aluminum and magnesium. It is in particular preferred for the coating 7 to comprise, for example, between 0.1 and 10 wt % of magnesium and between 0.1 and 20 wt % of aluminum.

Also preferably, the coating 7 comprises more than 0.3 wt % of magnesium, or even between 0.3 wt % and 4 wt % of magnesium and/or between 0.5 and 11 wt % or even between 0.7 and 6 wt % of aluminum, or even between 1 and 6 wt % of aluminum.

Preferably, the Mg/Al weight ratio between the magnesium and the aluminum in the coating 7 is strictly less than or equal to 1, or even strictly less than 1, or even strictly less than 0.9.

To produce the metal sheet 1, the following method may for example be used.

A substrate 3 is used that is for example obtained by hot, then cold rolling. The substrate 3 is in the form of a band that is caused to pass through a bath to deposit the coatings 7 by hot dipping.

The bath is a molten zinc bath containing magnesium and aluminum. The bath may also contain up to 0.3 wt % of each of the optional additional elements, such as Si, Sb, Pb, Ti, Ca, Mn, Sn, La, Ce, Cr, Ni, Zr or Bi.

These different elements may make it possible, inter alia, to improve the ductility or adhesion of the coatings 7 on the substrate 3. One skilled in the art who knows their effects on the characteristics of the coatings 7 will know how to use them based on the complementary aim sought. The bath may lastly contain residual elements coming from supply ingots or resulting from the passage of the substrate 3 in the bath, such as iron with a content of up to 5 wt %, and generally comprised between 2 and 4 wt %, for example.

After depositing the coatings 7, the substrate 3 is for example spun dry using nozzles projecting a gas on either side of the substrate 3. The coatings 7 are then left to cool in a controlled manner.

The band thus treated may next undergo a so-called skin-pass step, which makes it possible to cold work it so as to erase the elasticity plateau, set the mechanical characteristics and give it a roughness suitable for the subsequent operations that the metal sheet must undergo.

The means for adjusting the skin-pass operation is the elongation level, which must be sufficient to achieve the aims and small enough to preserve the subsequent deformation capacity. The elongation level is typically comprised between 0.3 and 3 wt %, and preferably between 0.3 and 2.2%.

The outer surfaces 15 of the coatings 7 are next oiled to provide temporary protection. The oils used can traditionally be Quaker or Fuchs oils, and the spread of the layers of oil deposited on each outer surface 15 is for example less than or equal to 5 g/m$^2$. The layers of deposited oils are not shown in FIG. 1.

The metal sheet 1 thus obtained can be wound before being cut, optionally shaped and assembled with other metal sheets 1 or other elements by users.

XPS (X-ray Photoemission Spectroscopy) spectroscopic analyses of the outer surfaces 15 of the coatings 7 have shown the preponderant presence of magnesium oxide or magnesium hydroxide, even when the coatings 7 have similar aluminum and magnesium content levels.

However, in the typical coatings essentially comprising zinc and aluminum in small proportions, the outer surfaces of the metal coatings are covered with a layer of aluminum oxide, despite the very low aluminum content level. For similar content levels of magnesium and aluminum, it would therefore have been expected to find a preponderant quantity of aluminum oxide.

XPS spectroscopy has also been used to measure the thickness of the layers of magnesium oxide or magnesium hydroxide present on the outer surfaces 15. It appears that these layers have a thickness of several nm.

It will be noted that these XPS spectroscopic analyses were done on specimens of metal sheets 1 that had not been subjected to corrosive environments. The formation of layers of magnesium oxide or magnesium hydroxide is therefore related to the deposition of the coatings 7.

Figure 2:
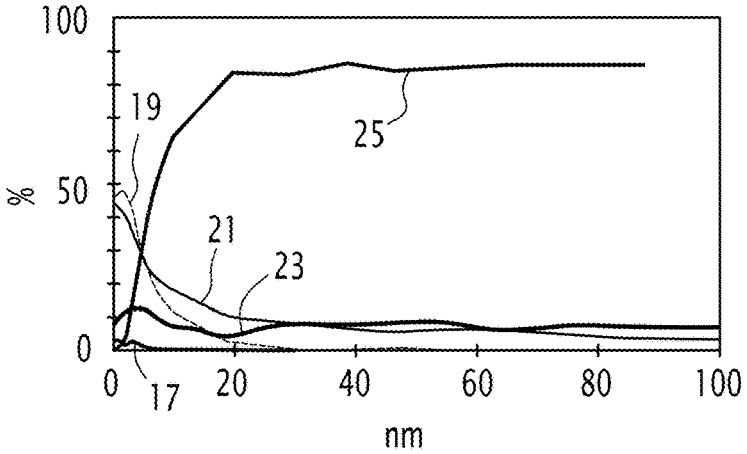
FIGS. 2 and 3 show the results of XPS spectroscopy analysis of the outer surfaces of the metal sheets.
Figure 3:
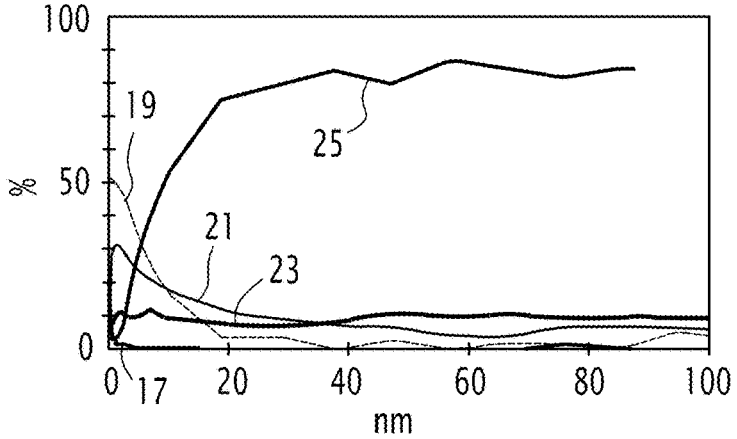

FIGS. 2 and 3 respectively illustrate the spectrums of the elements for energy levels C1s (curve 17), O1s (curve 19), Mg1s (curve 21), A12p (curve 23) and Zn2p3 (curve 25) during an XPS spectroscopic analysis. The corresponding atomic percentages are shown on the y-axis and the analysis depth on the x-axis.

The sample analyzed in FIG. 2 corresponds to coatings 7 comprising 3.7 wt % of aluminum and 3 wt % of magnesium and subjected to a traditional skin-pass step with an elongation level of 0.5%, while the specimen of FIG. 3 has not been subjected to such a step.

On these two specimens, according to the XPS spectroscopic analyses, it may be estimated that the thickness of the layers of magnesium oxide or magnesium hydroxide is approximately 5 nm.

It thus appears that these layers of magnesium oxide or magnesium hydroxide are not removed by the traditional skin-pass steps, or by the traditional alkaline degreasing and traditional surface treatments.

In parallel, the inventors observed that the metal sheets with Zn—Al—Mg coatings have a low ability to be wetted by the oil. This visually results in a deposition of protective oil in the form of droplets, whereas it is continuous or film-forming on the traditional galvanized coatings.

Figure 4:
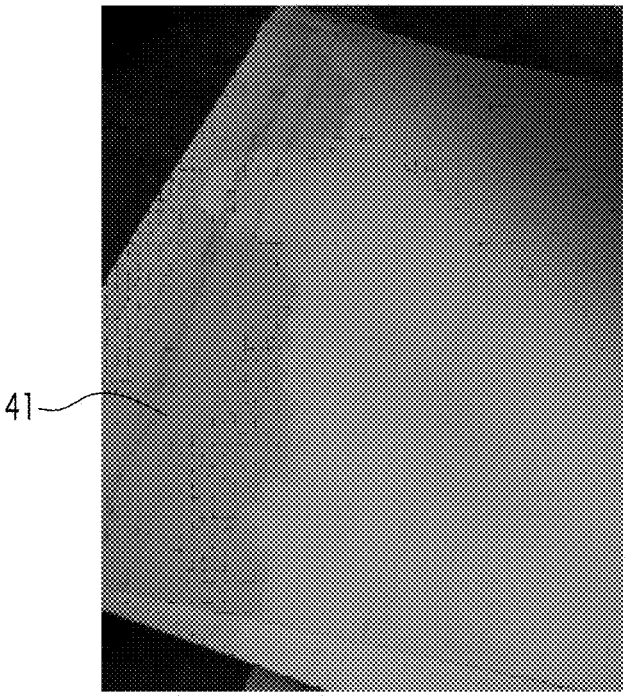
FIG. 4 is a negative illustrating the dewetting phenomenon.

The inventors have also observed dewetting phenomena of the deposited oil, such that certain zones are no longer covered with oil. One such zone is identified by reference 41 in FIG. 4. The temporary protection is therefore heterogeneous.

Furthermore, dulling phenomena, regardless of whether they are related to dewetting, may appear several weeks later under some storage conditions.

The inventors lastly observed that these drawbacks could be either reduced or eliminated, and the temporary protection improved, by including, in the method for producing a metal sheet 1, a step for altering layers of magnesium oxide or magnesium hydroxide present on the outer surfaces 15 of the coatings 7, before applying oil.

This alteration step may be carried out using any suitable means, for example, the application of mechanical forces.

Such mechanical forces may be applied by a roller leveler, brushing devices, shot-blasting devices, etc.

These mechanical forces may serve, due to their action alone, to alter the layers of magnesium oxide or magnesium hydroxide. Thus, the brushing and shot-blasting devices may remove all or part of those layers.

Likewise, a roller leveler, which is characterized by the application of a plastic deformation by bending between rollers, may be adjusted to deform the metal sheet that passes through it enough to create cracks in the layers of magnesium oxide or magnesium hydroxide.

The application of mechanical forces on the outer surfaces 15 of the metal coatings 7 can be combined with the application of an acid solution or the application of degreasing, for example with an alkaline solution, on the outer surfaces 15.

The acid solution for example has a pH comprised between 1 and 4, preferably between 1 and 3.5, preferably between 1 and 3, and still more preferably between 1 and 2. The solution may for example comprise hydrochloric acid, sulfuric acid or phosphoric acid.

The application duration of the acid solution may be comprised between 0.2 s and 30 s, preferably between 0.2 s and 15 s, and still more preferably between 0.5 s and 15 s, as a function of the pH of the solution, and the moment and manner in which it is applied.

The solution may be applied by immersion, aspersion or any other system. The temperature of the solution may for example be the ambient temperature or any other temperature and subsequent rinsing and drying steps can be used.

More generally, it is possible to alter the layers of magnesium oxide or magnesium hydroxide by applying an acid solution and without applying mechanical forces.

The purpose of the optional degreasing step is to clean the outer surfaces 15 and therefore remove the traces of organic dirtying, metal particles and dust.

Preferably, this step does not alter the chemical nature of the outer surfaces 15, with the exception of altering any aluminum oxide/hydroxide surface layer. Thus, the solution used for this degreasing step is non-oxidizing. As a result, no magnesium oxide or magnesium hydroxide is formed on the outer surfaces 15 during the degreasing step, and more generally before the oil application step.

If a degreasing step is used, it takes place before or after the step for applying the acid solution. The optional degreasing step and the step for applying the acid solution take place before an optional surface treatment step, i.e., a step making it possible to form, on the outer surfaces 15, layers (not shown) improving the corrosion resistance and/or the adherence of other layers subsequently deposited on the outer surfaces 15.

Such a surface treatment step comprises applying, on the outer surfaces 15, a surface treatment solution that reacts chemically with the outer surfaces 15. In certain alternatives, this solution is a conversion solution and the layers formed are conversion layers.

Preferably, the conversion solution does not contain chromium. It may thus be a hexafluorotitanic or hexafluorozirconic acid-based solution.

In the event the application of mechanical forces is combined with the application of an acid solution, the mechanical forces will preferably be applied before the acid solution or while it is present on the outer surfaces 15 to favor the action of the acid solution.

In that case, the mechanical forces may be less intense.

In one alternative, the step for applying the acid solution and the surface treatment step are combined.

In the latter case, the surface treatment solution is acid. In that case in particular, the pH can be strictly greater than 3, in particular if the surface treatment solution is applied at a temperature above 30° C.

In order to illustrate the invention, different tests were performed and will be described as non-limiting examples.

The tests were carried out with a metal sheet 1 whereof the substrate 3 is steel covered with coatings 7 comprising 3.7% aluminum and 3% magnesium, the rest being made up of zinc and impurities inherent to the method. These coatings have thicknesses of approximately 10 μm. Specimens of the metal sheet 1 were oiled beforehand with a Fuchs 4107S oil and a spread of 1 g/m$^2$.

As summarized in table 1 below, some of the specimens had previously been subjected to alkaline degreasing and/or the application of an acid solution. In the latter case, the nature of the acid, the pH of the solution and the application duration are indicated. The acid solutions were at ambient temperature. The specimens, once oiled, were all first observed with the naked eye so as to evaluate the continuous or discontinuous nature of the deposited layer of oil.

TABLE 1

| Specimen | Alkaline degreasing | Type of acid | pH | Exposure duration to the acid in s | Oil distribution observed with the naked eye |
|---|---|---|---|---|---|
| 1 | / | / | / | / | Discontinuous |
| 2 | Gardoclean S5117 at 25 g/l at a temperature of 55° C., applied for 15 s, | HCl | 2 | 5 | Continuous |
| 3 | / | HCl | 2 | 5 | Continuous |
| 4 | / | HCl | 1 | 5 | Continuous |
| 5 | / | HCl | 2 | 10 | Continuous |
| 6 | / | H2SO4 | 2 | 5 | Continuous |

The application of an acid solution, optionally combined with alkaline degreasing, therefore makes it possible to improve the oil distribution and therefore the temporary protection. These visual observations were also confirmed by Raman spectroscopy of the outer surfaces of the specimens.

Specimens 1 to 6 were also exposed to the ambient atmosphere for 12 weeks under the conditions described in standard VDA230-213 in order to evaluate their temporary protection.

The follow-up of the evolution of the dulling throughout the test was done via a colorimeter measuring the brightness deviation (measurement of ΔL*). Any brightness deviation greater than 2 during the 12 week period is considered to be detectable by the naked eye and must therefore be avoided.

Figure 5:
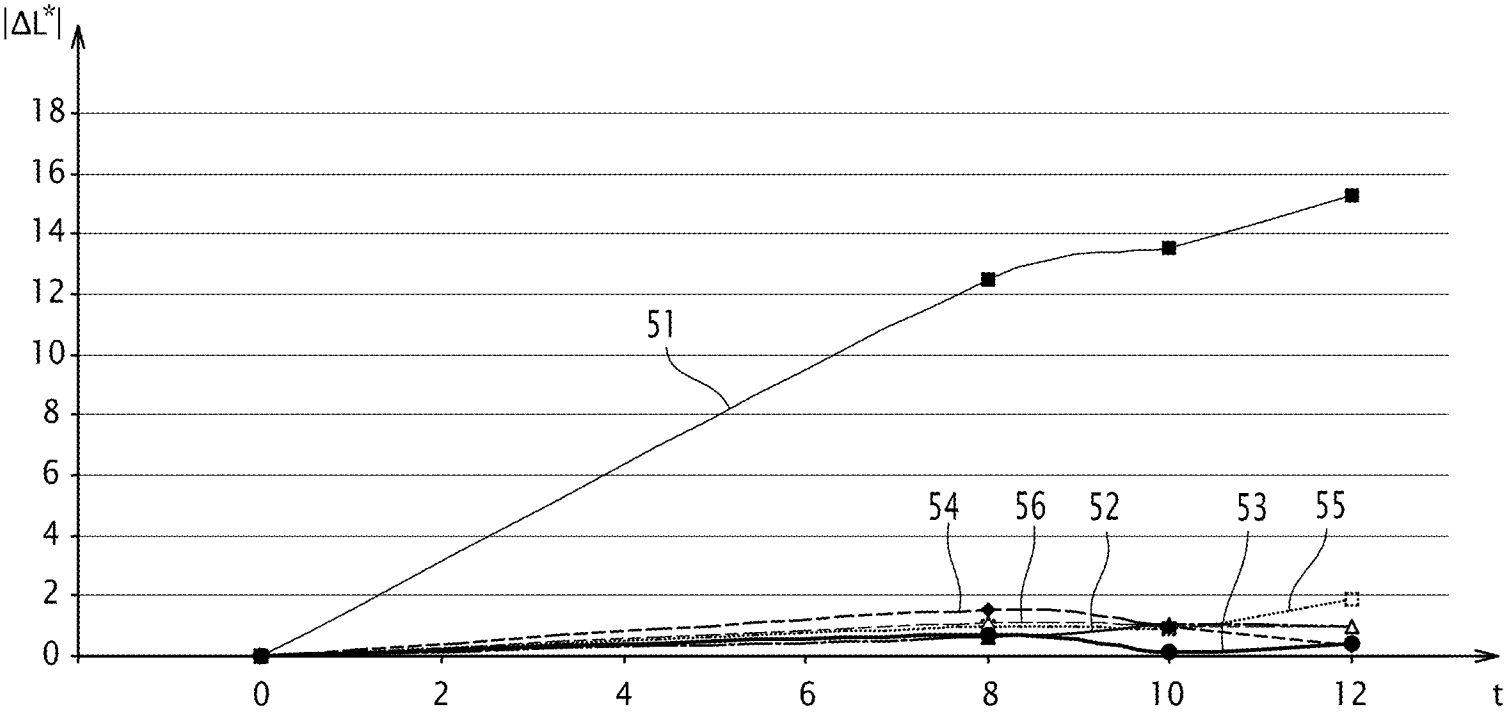
FIG. 5 shows curves illustrating the results of aging tests with natural exposure under shelter carried out on different test pieces of metal sheets treated according to the present invention or not treated.

The results obtained for specimens 1 to 6 are respectively shown in FIG. 5, where the time, in weeks, on the x-axis and the evolution of |ΔL*| is on the y-axis.

Specimen 1 (curve 51 in FIG. 5), which constitutes the reference, shows a ΔL greater than 2, which is in accordance with the discontinuous oil distribution observed visually.

Specimens 2 to 6 (curves 52 to 56, respectively, in FIG. 5) show a brightness variation of less than 2, therefore imperceptible to the naked eye.

What is claimed is:

1. A method for producing a metal sheet having two faces each coated with a metal coating comprising zinc, between 0.1 and 20 wt % of aluminum, and between 0.1 and 10 wt % of magnesium, the method comprising the steps of: providing a steel substrate having two faces;

depositing a metal coating on each face by hot dipping the steel substrate in a bath;

cooling the metal coatings;

altering layers of magnesium oxide or magnesium hydroxide formed on outer surfaces of the metal coatings by applying an acid solution on the outer surfaces of the metal coatings or by applying mechanical forces using a roller leveler, a brushing device, or a shot-blasting device on the outer surfaces of the metal coatings; and then depositing a layer of oil directly on the outer surfaces of the metal coatings.

2. The method according to claim 1, wherein the metal coatings comprise between 0.3 and 10 wt % of magnesium.

3. The method according to claim 2, wherein the metal coatings comprise between 0.3 and 4 wt % of magnesium.

4. The method according to claim 1, wherein the metal coatings comprise between 0.5 and 11 wt % of aluminum.

5. The method according to claim 4, wherein the metal coatings comprise between 0.7 and 6 wt % of aluminum.

6. The method according to claim 5, wherein the metal coatings comprise between 1 and 6 wt % of aluminum.

7. The method according to claim 1, wherein a weight ratio between the magnesium and the aluminum in the metal coatings is less than or equal to 1.

8. The method according to claim 1, further comprising a degreasing step by applying an alkaline solution on the outer surfaces of the metal coatings.

9. The method according to claim 1, further comprising a surface treatment step by applying a surface treatment solution on the outer surfaces of the metal coatings.

10. The method according to claim 1, wherein the altering step comprises applying an acid solution on the outer surfaces of the metal coatings.

11. The method according to claim 10, wherein the acid solution is applied during a duration between 0.2 s and 30 s on the outer surfaces of the metal coatings.

12. The method according to claim 10, wherein the acid solution has a pH between 1 and 4.

13. The method according to claim 12, wherein the solution has a pH between 1 and 3.5.

14. The method according to claim 13, wherein the acid solution has a pH between 1 and 3.

15. The method according to claim 14, wherein the acid solution has a pH between 1 and 2.

16. The method according to claim 10, wherein the acid solution is an acid surface treatment solution.

17. The method according to claim 16, wherein the acid surface treatment solution is an acid conversion solution.

18. The method according to claim 1, wherein mechanical forces are applied on the outer surfaces of the metal coatings before applying the acid solution or when the acid solution is present on the outer surfaces.

19. The method according to claim 18, wherein the mechanical forces are applied by passing the metal sheet through a roller leveler.

20. The method according to claim 1, wherein the altering step includes applying mechanical forces using a roller leveler, a brushing device or a shot-blasting device on the outer surfaces of the metal coatings.

21. The method according to claim 20, wherein the altering step includes applying mechanical forces on the outer surfaces of the metal coatings to crack the layers of magnesium oxide or magnesium hydroxide.

22. The method as recited in claim 1, wherein the altering step includes applying acid solution and mechanical forces on the outer surfaces.

* * * * *